US007773462B2

(12) United States Patent
Vuilleumier et al.

(10) Patent No.: US 7,773,462 B2
(45) Date of Patent: Aug. 10, 2010

(54) CHINESE MECHANICAL CALENDAR TIMEPIECE

(75) Inventors: Alain Vuilleumier, La Chaux-de-Fonds (CH); Frédéric Meylan, Neuchâtel (CH)

(73) Assignee: The Swatch Group Research and Development Ltd, Marin (CH)

( * ) Notice: Subject to any disclaimer, the term of this patent is extended or adjusted under 35 U.S.C. 154(b) by 334 days.

(21) Appl. No.: 11/813,267

(22) PCT Filed: Dec. 23, 2005

(86) PCT No.: PCT/EP2005/057148

§ 371 (c)(1),
(2), (4) Date: Apr. 11, 2008

(87) PCT Pub. No.: WO2006/069981

PCT Pub. Date: Jul. 6, 2006

(65) Prior Publication Data

US 2009/0274010 A1 Nov. 5, 2009

(30) Foreign Application Priority Data

Dec. 30, 2004 (EP) ..... 04031017

(51) Int. Cl.
*G04B 19/26* (2006.01)
*G04B 19/24* (2006.01)

(52) U.S. Cl. ..... 368/18; 368/15; 368/28

(58) Field of Classification Search ..... 368/15–18, 368/20, 28, 37, 223
See application file for complete search history.

(56) References Cited

U.S. PATENT DOCUMENTS 96,792 A * 11/1869 Gale ..... 368/37
4,055,749 A 10/1977 Kraushaar et al.
4,674,889 A 6/1987 Klaus et al.
5,457,663 A * 10/1995 Mejaski ..... 368/15
6,272,076 B1 * 8/2001 Dinger ..... 368/15
7,251,198 B2 * 7/2007 Barton ..... 368/18

OTHER PUBLICATIONS

International Search Report issued in corresponding application No. PCT/EP2006/057148, completed Mar. 29, 2006 and mailed Apr. 6, 2006.

Nachum Dershowitz and Edward M. Reingold, "The Chinese Calendar" from Calendrical Calculations, Cambridge University Press, 1997, pp. 241-264.

Helmer Aslaksen: "The Mathematics of the Chinese Calendar," May 13, 2004, pp. 1-52.

CD containing LeapMonths. nb, Mathematica package 1999 available on the site www.math.nus.edu.sg.

* cited by examiner

*Primary Examiner*—Vit W Miska
(74) *Attorney, Agent, or Firm*—Griffin & Szipl, P.C.

(57) ABSTRACT

A watch includes a mechanical or electromechanical timepiece movement, analog time indicators, a lunar indicator indicating lunar date on a scale and driven by the timepiece movement to perform one revolution in one or two synodic months, and Chinese calendar indicator members actuated by a calendar mechanism driven from the lunar indicator. A month moving part provided with an indicator of lunar months is driven via a rocking lever so as to perform one revolution per ordinary year of twelve months and per leap year of thirteen months. The other Chinese calendar indicators are driven from the month moving part and comprise a first year indicator performing one revolution in twelve years, a second year indicator performing one revolution in ten years, and a third year indicator performing one revolution in nineteen years and associated with a cam representing the Chang cycle of ordinary years and leap years.

20 Claims, 11 Drawing Sheets

Fig. 12
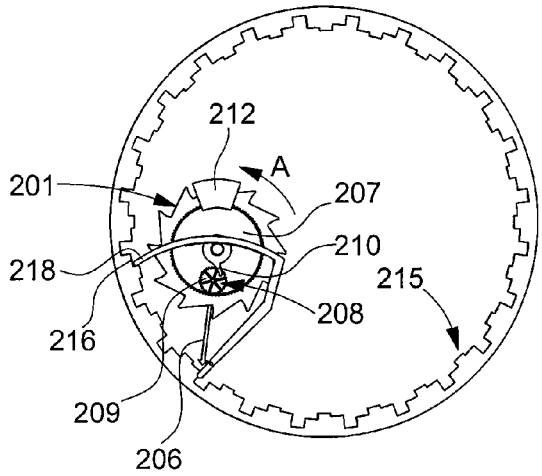
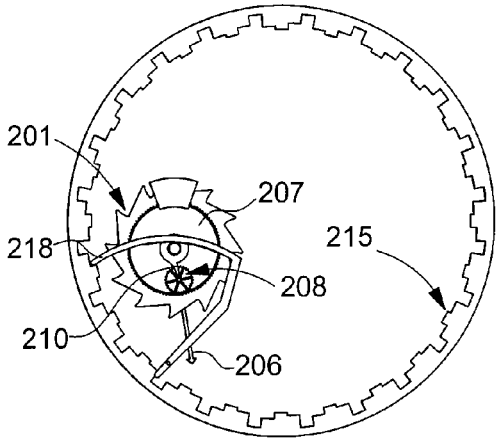
Fig. 13
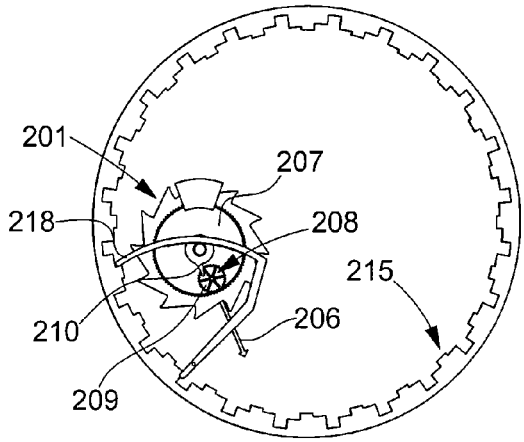
Fig. 14

CHINESE MECHANICAL CALENDAR TIMEPIECE

This is a National Phase Application in the United States of International Patent Application No. PCT/EP2005/057148 filed Dec. 23, 2005, which claims priority on European Patent Application No. 04031017.9, filed Dec. 30, 2004. The entire disclosures of the above patent applications are hereby incorporated by reference.

FIELD OF THE INVENTION

The present invention relates to a timepiece of the kind comprising a timepiece movement, time indicator members, a lunar indicator member driven by the timepiece movement and performing one revolution during an integral number of synodic months, calendar indicator members which are movable relative to the dial and a calendar mechanism driven from the timepiece movement.

BACKGROUND OF THE INVENTION

Calendar watches are usually arranged to indicate the values appropriate to a solar calendar, more particularly the Julian calendar or the Gregorian calendar. The calendar mechanism is essentially arranged to count the number of days appropriate to each month and when applicable to count the months and to increment a year counter every twelve months. This mechanism is thus simply actuated once per day by the timepiece movement, by means of a wheel driven by the hour wheel with a ratio of 1:2.

The present invention proposes to incorporate calendar indicator members for the traditional Chinese calendar into a timepiece. Nowadays, the Chinese calendar is still used to set the date of some festivals and for Chinese astrology. This calendar is very different from western ones because it is mainly based on the synodic months, whose mean duration is not equal to an integral number of days. The known mechanisms for displaying the values of the Julian calendar or other solar calendars accordingly cannot be used for this purpose.

The Chinese calendar is of the lunar-solar type, in the sense that it is based on the lunar months which correspond to the synodic months, while the Chinese years have a variable duration in order to approximate tropical years as far as possible, i.e. the apparent movement of the sun at the ecliptic. This calendar comprises a cycle of nineteen years, called the Chang cycle, which comprises as near as can be an integral number of lunar months (235) and of tropical and Chinese years (19) and whose beginning is set in such a manner as to satisfy the historical requirement fixing the Chinese New Year at the second new moon which follows the winter solstice, apart from rare exceptions. Each of these periods of nineteen Chinese years comprises twelve ordinary years of twelve lunar months and seven years called leap years of thirteen lunar months. If the years in the Chang cycle are numbered, the leap years typically have the numbers 1, 4, 7, 10, 12, 15 and 18. These years comprise a supplementary lunar month also having the duration of a synodic month, which is called a "leap month". This month is intercalated between two of the ordinary months at a non cyclic position which depends on astronomical data and which thus varies from one leap year to another. The lunar months which follow it keep the same name or number as in an ordinary year. Depending on the time of the new moon on each involved New Year's Day, an ordinary year of the Chinese calendar can comprise 353, 354 or 366 days while a leap year can comprise 383, 384 or 385 days.

For more information regarding the Chinese calendar the reader can refer to the publication of Nachum DERSHOWITZ and Edward M. REINGOLD, Calendrical Calculations, Cambridge University Press, 1997; also the publications or Helmer ASLAKSEN: The Mathematics of the Chinese Calendar, 13 May 2004 and LeapMonths.nb, Mathematica package 1999 available on the site www.math.nus.edu.sg. We will only mention here that the Chinese years are not identified by a number but by a name formed by the combination of two terms comprising a heavenly stem and a earthly branch. There are ten earthly stems, each formed by association of one of five elements (wood, fire, earth, metal, water) with the term "Yang", then with the term "Yin" the following year, which gives a cycle of ten years. Moreover there are twelve earthly branches carrying the names of animals of twelve constellations of the Chinese zodiac, which are traversed in twelve years by Jupiter. Through the combination of two cycles of ten and twelve years, the names of the Chinese years repeat with a cycle of sixty years.

SUMMARY OF THE INVENTION

The subject of the present invention is a timepiece which can made in the form of a mechanical calendar watch capable of indicating the cycles of twelve and thirteen lunar months of the Chinese year. In addition, the mechanical calendar should also be able to indicate the names of the Chinese years, specifically the heavenly stems and the earthly branches defining the sexagesimal cycle of years of the Chinese calendar.

To this end there is provides a timepiece comprising a timepiece movement, a dial (21), time indicator members (24, 25, 42), a lunar moving part (27, 101) driven by the timepiece movement and performing one revolution during an integral number of synodic months, calendar indicator members (34, 37, 40, 44, 47, 105, 124, 140) which are movable relative to the dial, and a calendar mechanism (50) driven by the timepiece movement and comprising a moving part (70, 120) for months which completes one revolution per ordinary year and per leap year, characterized in that the calendar is a lunar-solar calendar comprising ordinary years comprising twelve lunar months and leap years comprising thirteen lunar months, and in that the moving part (70, 120) for months is driven by the lunar moving part (27, 101). The month moving part is preferably associated with a month indicator and the lunar moving part is associated with an indicator of the age of the moon. Thus the respective numbers of the lunar day, that is to say the age of the moon, and of the lunar month which is indicated by the month indicator can be read on the dial.

According to a preferred construction enabling the above-mentioned functioning of the month indicator to be obtained, the calendar mechanism comprises a rocking lever arranged to bear against a cam called a Chang cam, comprising nineteen or a multiple of nineteen angular sectors with respective small or large heights to represent years of twelve or thirteen lunar months, the Chang cam being driven by the month moving part so as to turn through an angle corresponding to one sector at the end of each revolution of the moving part. The rocking lever is actuated once per lunar month by a cam connected to the lunar moving part and has a first nose arranged to advance the month moving part by a thirteenth of a revolution on each actuation of the rocking lever and the rocking lever is further provided with a second nose arranged to engage in a recess of the month moving part to advance this moving part by a supplementary thirteenth of a revolution in the course of each year in which the rocking lever bears against a sector of the Chang cam of small radius. The recess is preferably located on a cam of spiral form forming part of the month moving part, the second nose being formed by a pawl mounted on the rocking lever and biased by a spring to be applied elastically against the cam.

The timepiece preferably comprises other calendar indicator members which are driven by the month moving part and comprise: a first year indicator which effects a revolution in twelve years and indicates the earthly branches, a second year indicator which effects a revolution in ten years and indicates the heavenly stems and the Yang or Yin term, and a third year indicator which is coupled to the Chang cam and indicates the position of the current year in the cycle of nineteen years. The combined indications of the first and second year indicators form the complete cycle of names of the years in the Chinese calendar in sixty years. The third year indicator enables the user to see whether the current year is a leap year and allows a watchmaker to regulate the positions of the elements of the mechanism when needed.

BRIEF DESCRIPTION OF THE DRAWINGS

Further features and advantages of the present invention will appear from the following description which describes various advantageous embodiments, by way of non-limiting example, with reference to the accompanying drawings, in which.

DETAILED DESCRIPTION OF VARIOUS EMBODIMENTS

Figure 1:
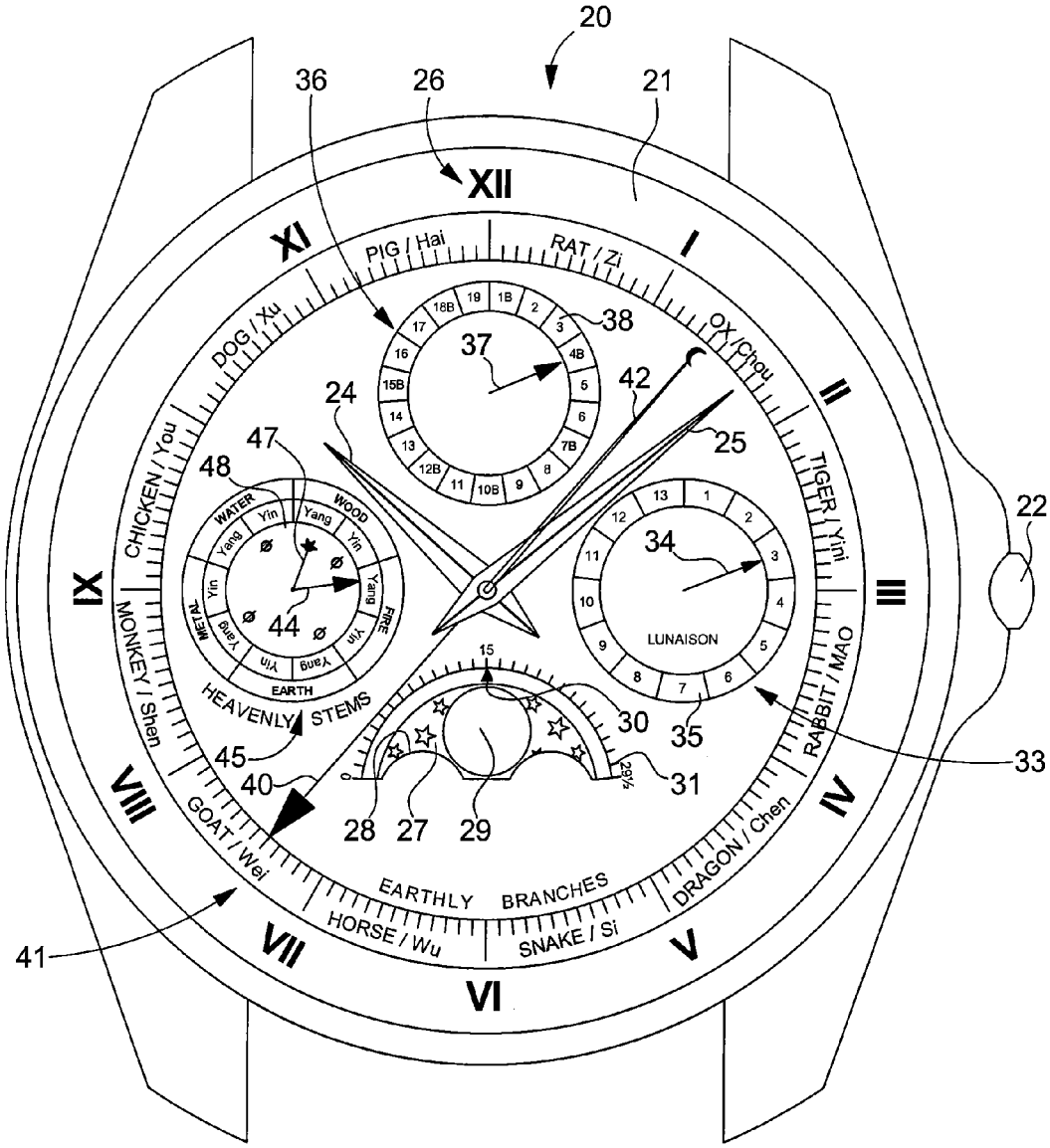
FIG. 1 shows the upper face of a wrist watch, in particular its display members, according to a first embodiment of the invention.

In a conventional manner, the wrist watch 20 shown in FIG. 1 comprises on its upper face a dial 21 associated with a plurality of rotary indicator members, such as hands or discs which turn relative to corresponding scales placed on the dial 21. These indicator members are driven by the timepiece movement of the watch 20, which can be mechanical or electro-mechanical. The watch comprises customary control members of a calendar watch, in particular a control stem provided with an outer crown 22 and means for correcting the calendar. In the example described above all the indicator members turn clockwise.

The display members comprise firstly an analog display of the time, hour, by means of an hour hand 24 and a minute hand 25, for which the scale 26 is the usual circle of hours. Obviously a seconds hand can also be provided but it is not present in this example.

An indicator of the phases and the age of the moon comprises a moon disc 27 which, in conventional manner, takes two synodic months to complete a revolution. The disc 27 is visible in a window 28 of unusual shape and it carries two images 29 of the moon and two pointers 30 moving one after the other relative to a semicircular scale 31 of the dial, which represents 29.5 days and thus allows the lunar date to be read.

The other indicator members shown in FIG. 1 are indicators for the Chinese calendar. A month indicator 33 comprises a hand 34 (or a disc on which a hand is shown) which makes one revolution per year relative to a scale 35 divided into thirteen equal numbered fields which represent the numbers of the synodic months, otherwise called lunar months.

An indicator 36 for the cycle of nineteen years, or Chang cycle, indicates the rank of the Chinese year in the cycle, by a hand 37 (or a disc on which a hand is shown) against a scale 38 with nineteen equal fields. The letter B added to some of the year numerals indicates that this is a leap year, that is to say it comprises thirteen months. The hand 37 makes one revolution in nineteen Chinese years.

A central hand 40 making one revolution in twelve Chinese years indicates the earthly branches against a scale 41 divided into twelve equal fields which correspond to the twelve earthly branches, i.e. to the twelve constellations of the Chinese zodiac traversed in twelve years by Jupiter and carrying the names of twelve animals. The same fields of the scale 41 are used to indicate the signs of the zodiac of the Chinese hours by means of another central hand 42 making one revolution in twenty four legal hours. It is noted that the twelve fields of the scale 41 each face one of the intervals of the ring of hours 26, to simplify the appearance of the dial, but this is not essential.

The names of the animals are here indicated in English and in transcription of the Chinese; they signify RAT, OX, TIGER, RABBIT, DRAGON, SNAKE, HORSE, GOAT, MONKEY, CHICKEN, DOG and PIG respectively.

A hand 44 for the heavenly stems makes one revolution in ten Chinese years and indicates the heavenly stems against a scale 45 having ten equal fields, formed by five element fields (wood, fire, earth, metal, water), each of which is divided into two equal parts, Yang and Yin. The combination of the successive indications of the two hands 40 and 44 forms the cycle of sixty years of the Chinese calendar.

A variant allowing the same results to be attained consists in replacing the Yang and Yin fields of the scale 45 by a separate indicator, displaying Yang and Yin alternately. This solution would allow larger symbols on the dial but the mechanism would be more complex.

In FIG. 1 there is also shown a hand 47 performing one revolution per tropic year in order to represent the movement of the sun at the ecliptic, relative to four symbols 48 for the equinoxes and solstices. This indication is independent of the lunar calendar and it can be obtained by means of transmission with a ratio of 1:365.25 from an element performing one revolution per day.

Figure 2:
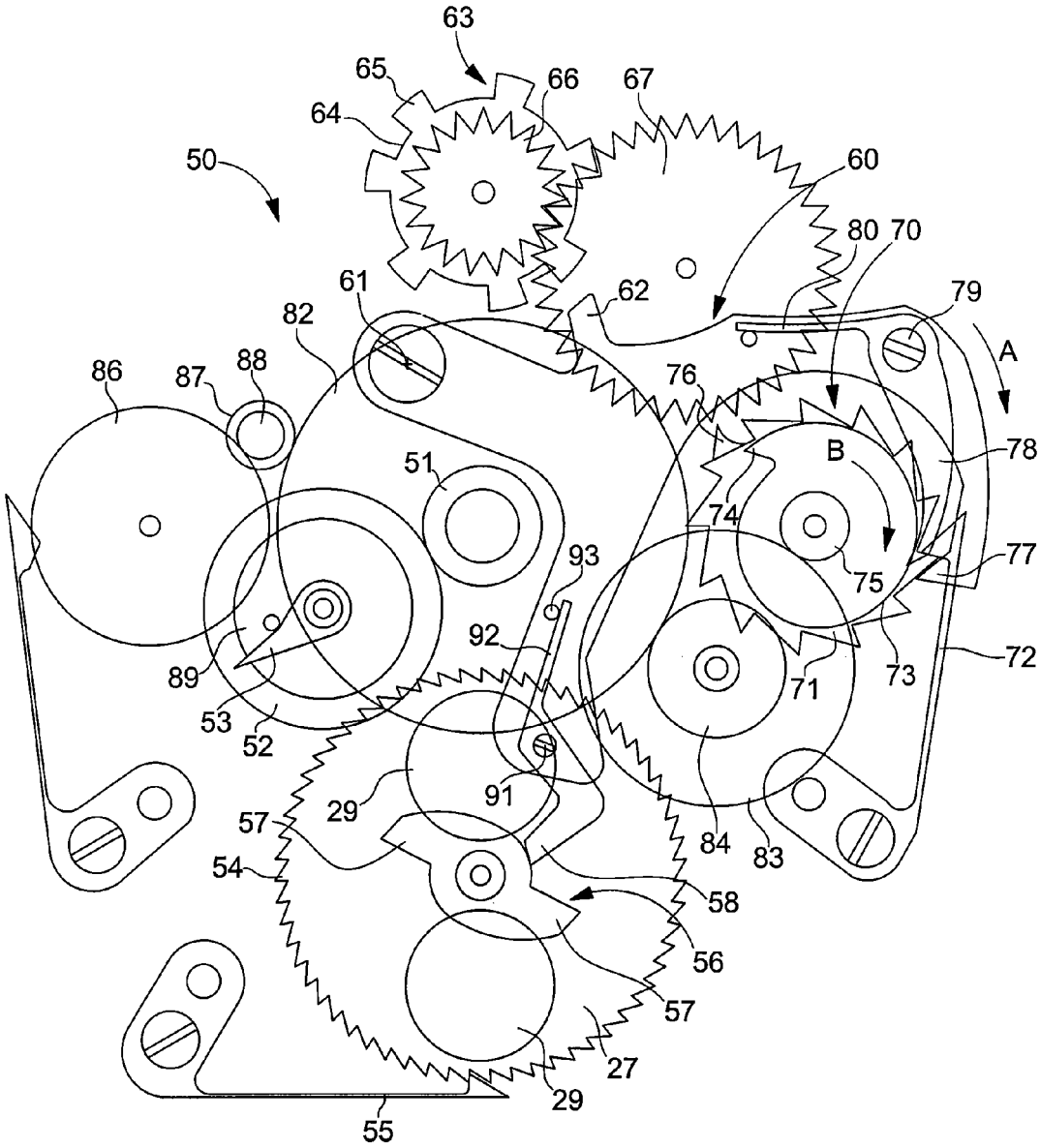
FIG. 2 is a transparent view showing the calendar mechanism of the watch of FIG. 1 schematically.

FIG. 2 shows the mechanism 50 driving the indicators 27, 34, 37, 40 and 44 of the lunar-solar calendar from the hour wheel 51 of the timepiece movement of the watch, this wheel being fixed to the hour hand 24. The wheel 51 meshes with a wheel 52 performing one revolution in twenty four hours and having a finger 53 which advances the toothing 54 with fifty nine teeth of the lunar disc 27 by one step per day, the position of this disc being held by a detent spring 55. The disc 27 thus completes a revolution in 59 days. Obviously a transmission ratio other than 1:59 could be provided, for example 16:945, so that the duration of a half revolution of the lunar disc 27 corresponds more accurately to the mean duration of a synodic lunar month.

The lunar disc 27 is provided with a cam 56 having two arms 57 in the form of a spiral disposed symmetrically, each of which corresponds to one synodic month. A finger 58 of a rocking lever 60 is applied to this cam, the pivotal axis of the rocking lever being indicated at 61. In order to be able to yield elastically beyond a certain applied force, the finger 58 is pivotally mounted on the rocking lever 60 at 91 and has a leaf spring 92 bearing against a pin 93 of the rocking lever. A spring, not shown, biases the rocking lever 60 to pivot in the sense of the arrow A, in order to keep its finger 58 constantly applied to the cam 56.

Another finger 62 of the rocking lever 60 serves as a follower applied to a Chang cam 63 which represents the Chang cycle of nineteen years. Thus the periphery of the cam 63 is divided into nineteen sectors having the same angular extent but a radius which can be either a low value, representing an ordinary year with twelve months, as does the sector 64, or a high value corresponding to a leap year with thirteen months, as does the sector 65. The cam 63 is fixed to the hand 37 (FIG. 1) and to a wheel 66 with nineteen teeth which meshes with an intermediate wheel 67 whose number of teeth is an integral multiple of nineteen, in this case thirty eight teeth.

The month hand 34 shown in FIG. 1 is fixed to a month moving part 70 performing one revolution per year of the Chinese lunar-solar calendar, this year counting twelve or thirteen lunar months as indicated by the cam 63. The moving part 70 comprises a wheel with thirteen teeth 71, held in position by a detent spring 72, a spiral cam 73 having a recess 74, a pinion 75 and a finger 76 which advances the wheel 67 by one tooth once per year and thus turns the Chang cam 63 and the hand 37 associated with it by a nineteenth of a revolution.

The rocking lever 60 has first nose 77 arranged to advance the wheel 71 by one step, as well as a second nose 78 formed by a pawl pivoted on the rocking lever at 79 and biased by a spring 80 which keeps it against the cam 73. The noses 77 and 78 enable the rocking lever to pivot the moving part 70 step by step in the sense of the arrow B in the following manner.

The rocking lever 60 is actuated once per lunar month by the cam 56 and then pivots in the sense opposite the arrow A, until its feeler finger 62 is applied against that one of the sectors 64 and 65 which represents the current Chinese year. During each month of a leap year, the feeler finger 62 and the rocking lever are arrested by a high sector 65 of the Chang cam, while the other finger 58 of the rocking lever is forced back elastically by the cam 56 which continues to rotate.

At the instant when the lunar disc 27 advances, corresponding to a new moon, the end of the spiral arm 57 of the cam 56 passes beyond the finger 58, so that the rocking lever 60 is freed and pivots rapidly in the sense of the arrow A about the point 61 under the action of its spring, not shown. Its nose 77 then comes into contact with the toothing of the wheel 71 and instantaneously advances the moving part 70 and the month hand 34 by a thirteenth of a revolution. During a normal year (with twelve months), the finger 62 of the rocking lever 60 can come into contact with the Chang cam 63 in a sector 64 of small radius, so that the rocking lever 60 pivots with a large amplitude. Its pawl 78 then performs a relatively large movement along the cam 73 and, at the instant of the year when this movement takes place in the vicinity of the recess 74 of the cam, it advances the month moving part 70 by a supplementary step, just before the normal step produced by the nose 77. The month hand 34 thus advances by two steps and is positioned at the value 1 of the scale 35.

On the contrary, during a leap year (i.e. with thirteen months), the finger 62 of the rocking lever 60 is applied to the Chang cam 63 in a sector 65 of large radius, so that the subsequent pivoting of the rocking lever in the sense of A only has a small amplitude and the pawl 78 is unable to engage with the recess 74. It then requires thirteen movements of the rocking lever 60 to produce a revolution of the month moving part 70.

The finger 76 is positioned by the moving part 70 in a position such that it advances the wheels 67 and 66 under the action of the rocking lever 60 at the end of the last synodic month of the Chinese year. At this instant, the passage to the Chinese New Year is indicated by the hand 34 jumping to the month number 1 and the hand 37 jumping to the following year on the Chang cycle scale 38. This movement is instantaneous because it accompanies that of the moving part 70.

The hand 40 shown in FIG. 1 is fixed to a central wheel of the earthly branches 82 which performs one revolution in twelve years. This wheel is driven by the moving part 70 with a transmission ratio of 1:12 by means of an intermediate moving part comprising a wheel 83 which meshes with the pinion 75 and a wheel 84 which meshes with the wheel 82. For example, the numbers of teeth of the elements 75, 83, 84 and 82 can be respectively 13, 52, 26 and 78 teeth. Thus, within each of the twelve fields of the scale 41 representing the earthly branches, the hand 40 performs thirteen steps per Chinese year, two steps being effected on the same day in the course of an ordinary year.

The hand 44 shown in FIG. 1 is fixed to a wheel 86 for heavenly stems which is driven from the central wheel 82 so as to perform one revolution in ten years, via a transmission train comprising two wheels 87 and 88. In order to implement the transmission ratio of 5:6, the numbers of teeth of the wheels 82, 87, 88 and 86 can for example be respectively 78, 13, 9 and 45. According to a variant the wheel 86 could be driven from the moving part 70 with a ratio of 1:10.

As has been mentioned above, the hand 42 indicating the Chinese hours performs one revolution in twenty four legal hours, which is also the speed of rotation of the wheel 52. This hand can thus be fixed to a central wheel, not shown, which meshes with a wheel 89 of the same diameter fixed to the wheel 52. However, in order that the position of the hand 42 can be based either on the lunar time at Peking or on the local lunar time, or on any time zone whatsoever, it will be desirable to interpose a friction device in the transmission driving this hand, to allow regulation of its position relative to the hour hand 24 as a function of the position where the wearer of the watch is located.

Obviously the calendar mechanism shown in FIG. 2 can be equipped with various adjusters allowing various indicator members to be placed in the desired position, especially after a time of stoppage of the watch. Devices of this kind actuated by means of small buttons fitted in the circumference of the case are well known in the field of calendar watches and do not need to described in detail here.

The calendar mechanism described above thus automatically reproduces the cycles of 19 and 60 years of the Chinese calendar, so that it can be called perpetual.

Other embodiments of the invention will now be described with reference to FIGS. 3 to 9, using the same reference numerals for the parts equivalent to those of the example described above.

Figure 3:
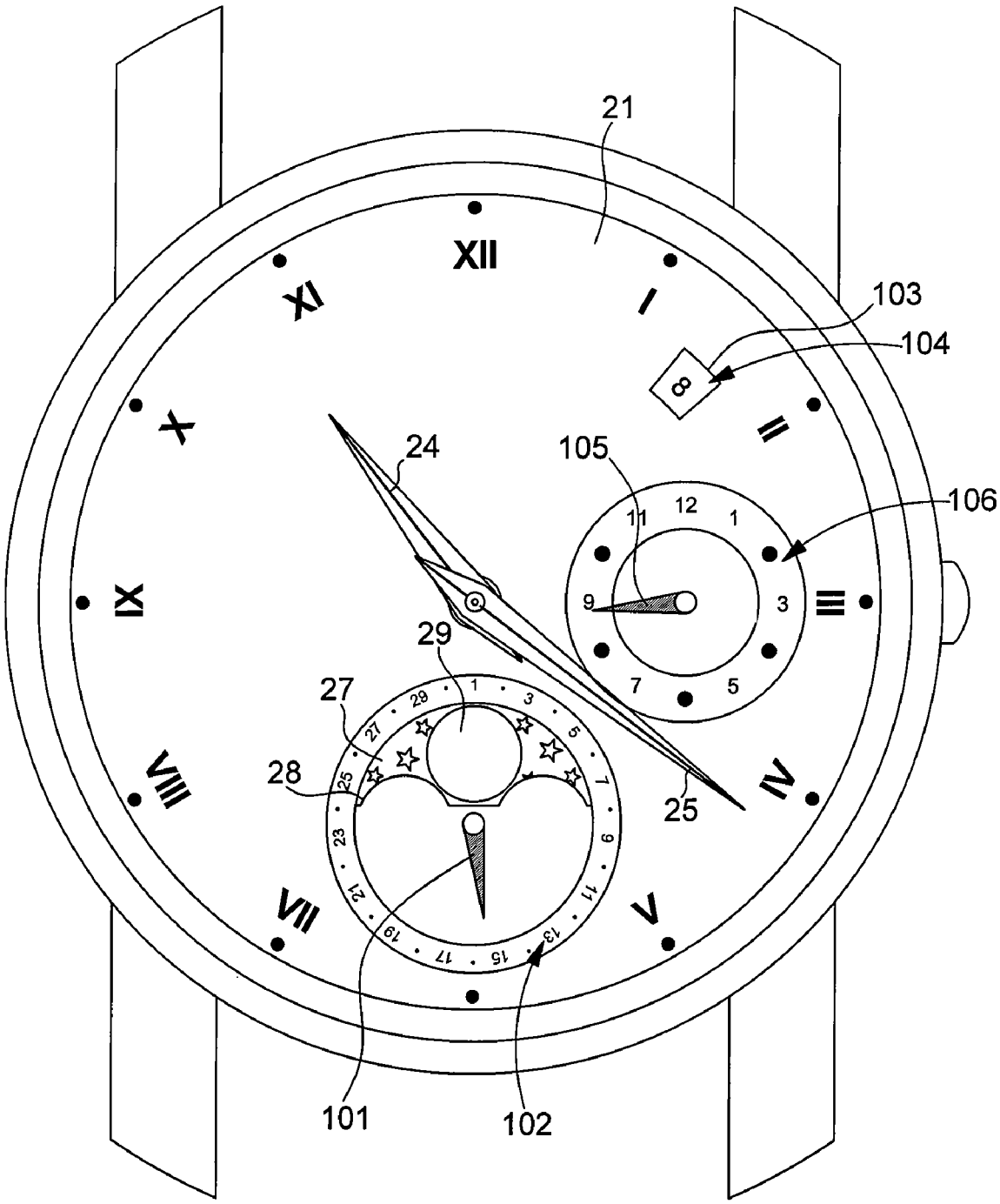
FIGS. 3 and 4 are views like FIGS. 1 and 2 and represent a second embodiment of the invention.
Figure 4:
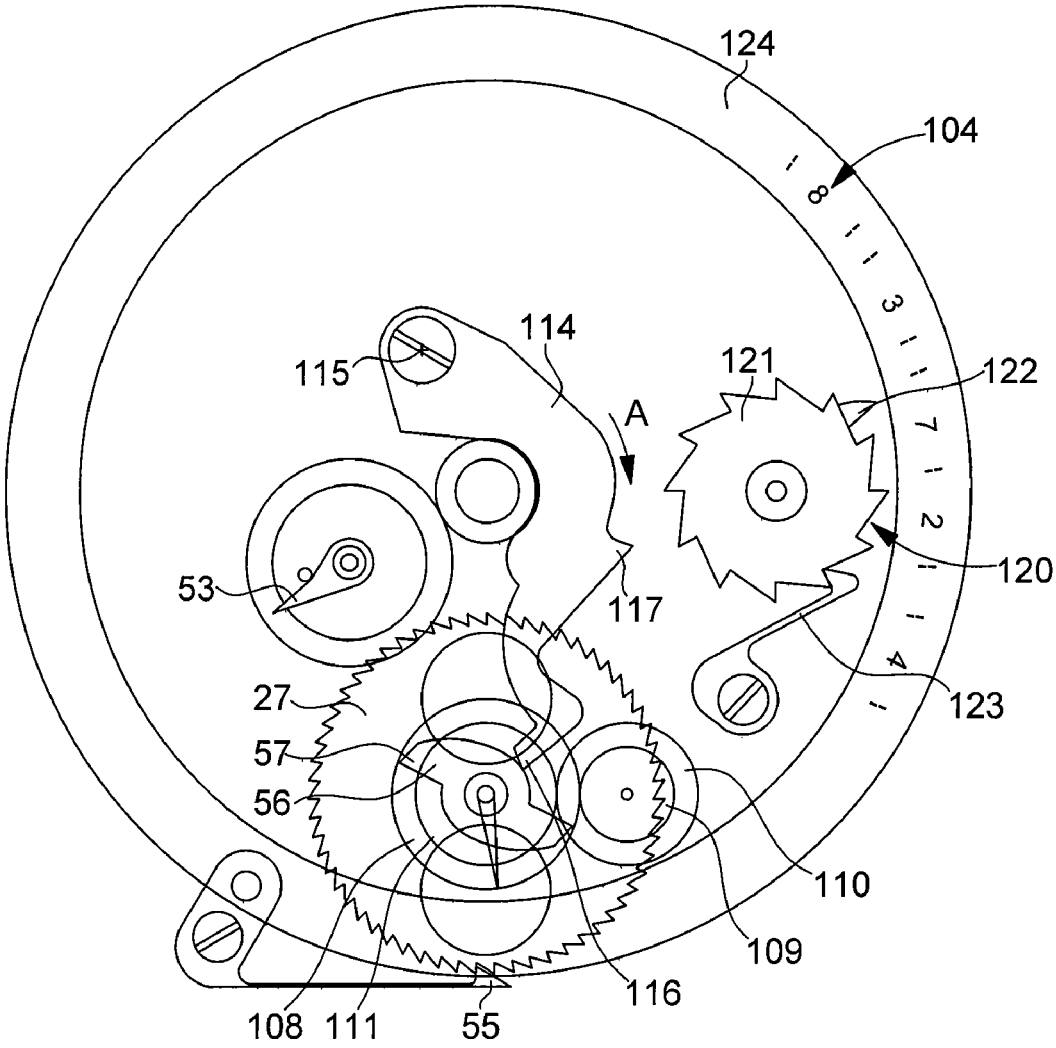

FIGS. 3 and 4 show a simplified embodiment of the invention schematically. The display according to FIG. 3 is greatly simplified compared with the version of FIG. 1, through omission of the pointer 30 and the hands 37, 40, 42, 44 and 47, as well as the corresponding scales. The pointer 30 is replaced by a hand 101 for the lunar date, adapted to perform one revolution in thirty days relative to a circular scale 102. In this case the number (reference 104) is displayed in a window 103 of the dial 21 for the leap month during a Chinese leap year. During an ordinary year the window can remain empty or display a sign for normal in place of this number. The lunar months are indicated by a hand 105 on a circular scale 106 which has only twelve positions in this example.

The corresponding mechanism, shown in FIG. 4, is clearly without the wheel trains driving the hands of the first embodiment which are omitted here but there are other differences. The moon disc 27 operated by the finger 53 has 60 teeth round its circumference. It carries a wheel 108 to drive a wheel 111 fixed to the lunar date hand 101 via a transmission train of two wheels 109, 110 with a transmission ratio of 2. A conventional push button manual adjuster, not shown, allows the disc 27 to be advanced step by step with its hand 101. A rocking lever 114 pivoted at 115 is biased in the sense of the arrow A by a spring, not shown, so that its finger 116 remains constantly in sliding contact against the cam 56 fixed to the disc 27. The rocking lever has a nose 117 which actuates the month moving part 120 step by step. This is greatly simplified compared with the moving part 70 of the previous example because it only comprises a wheel 121 having twelve teeth in place of thirteen, carrying the hand 105 and a finger 122 and being kept in position by a detent spring 123. A year ring 124 provided with internal teeth, not shown, has on its upper face some number N of equal fields which appear in succession in the window 103 and can each carry an indication appropriate to the Chinese year in question. As mentioned above it is arranged in this example to indicate the number 104 of the leap month of each leap year of the Chinese calendar in the window. Since the series of these numbers is not cyclical, the ring 124 is only usable for N years, when it has to be replaced by a ring carrying the indications appropriate to the following N years. The number N of fields on the ring can run to at least around 60 years without the indication 104 becoming too small.

As in the preceding example, the moon disc 27 advances by one step per day under the action of the finger 53 and its cam 56 raises the rocking lever 114 little by little during a synodic month. At the same time the disc drives the hand 101 at the rate of one revolution in thirty days to indicate the age of the moon, otherwise called the lunar date. When the lunar month only extends over twenty nine solar days, the user of the watch must actuate the adjuster for the day of the new moon, so that the hand 101 makes a supplementary step on this day to pass from 29 to 1 on the scale 102. This correction can be made at a time chosen by the user.

At each new moon, at the instant when the hand 101 comes into position opposite the number 1 of the scale 102, the end of the arm 57 of the cam 56 reaches the finger 116 of the rocking lever 114, the nose 117 engages the teeth of the wheel 121, which advances with the hand 105 by one step, then the finger 116 falls back into the following recess of the cam 56. At the new moon of the Chinese New Year, the finger 122 is facing the teeth of the ring 124 and it thus advances this ring by one step to show the indication characteristic of the new year in the window 103.

During the whole of a Chinese leap year the number 104 of the supplementary lunar month (called the leap month) is indicated to the user in the window 103. When the hand 105 arrives at the number of the following month, the user should step the month moving part 120 on by one step by means of a conventional adjuster (not shown) in order that the hand 105 returns to the number of the leap month, since this number should be repeated for the following lunar month. Thus the last lunar month of the leap year will always be the number 12 and the finger 122 will perform its role at the right moment, although the moving part 120 will have been actuated thirteen times by the rocking lever in the course of this year.

It is noted that the rocking lever 114 has a delayed effect on the moving 120. Nevertheless a rocking lever with instantaneous effect could be used in this mechanism, in the nature of the rocking lever 60 described above, but this takes up more space.

Figure 5:
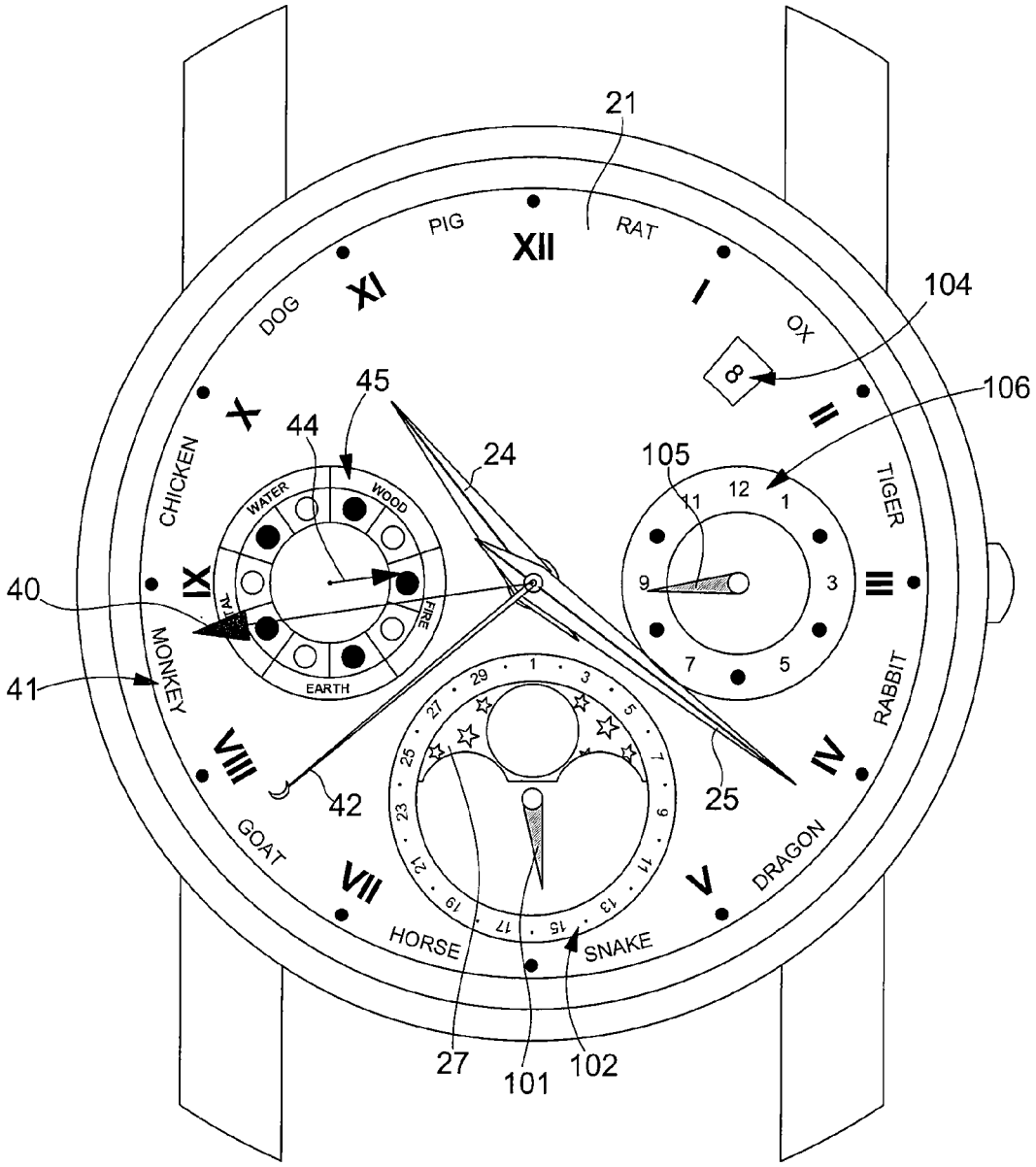
FIG. 5 is a view like FIG. 1 and shows a third embodiment of the invention.

FIG. 5 shows an embodiment comprising the same elements as those of FIGS. 3 and 4 but supplemented by indications of the Chinese calendar which are present in the first embodiment, illustrated in FIGS. 1 and 2, namely: the hand 40 indicating the earthly branch of the year relative to the scale 41 according to a cycle of twelve years, the hand 44 indicating the element and the Yang or Yin sign of the year on the scale 45 according to a cycle of ten years, and the hand 42 indicating the sign of the zodiac of Chinese time on the scale 41. The corresponding wheel trains are the same as in FIG. 2 and are driven by the pinion 75, added for this purpose on the month moving part 120 shown in FIG. 4.

FIGS. 10 to 14 show a display device for lunar months which will count the leap years of the Chinese calendar and which can be incorporated in various embodiments of the invention, in particular those of FIGS. 3 to 5, to replace the elements 103 to 106 and the month moving part 120.

Figure 10:
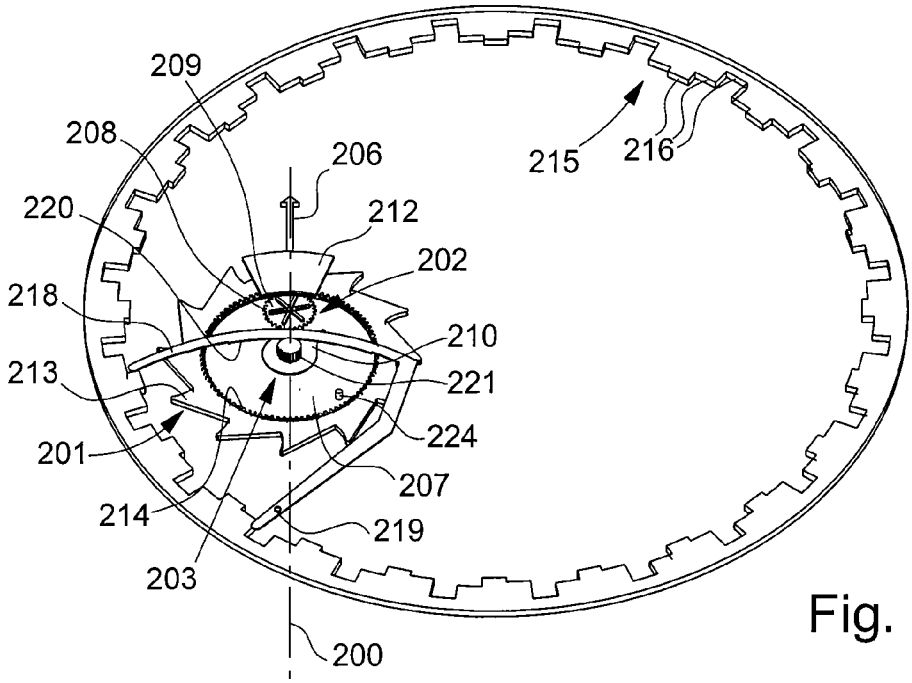
FIG. 10 is a schematic perspective view from below of a display device for lunar months in the Chinese calendar, which device can be incorporated in various embodiments of the invention.
Figure 11:
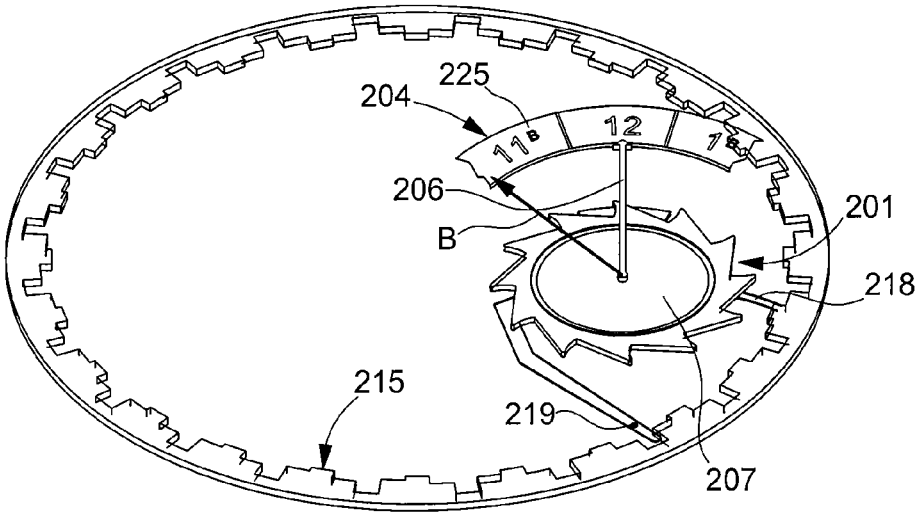
FIG. 11 is a schematic perspective view from above of the display device of FIG. 10, and FIGS. 12 to 14 are schematic views from below showing different positions of the display device of FIG. 10.

The display device shown in FIGS. 10 and 11 comprises three concentric parts rotating about a common axis 200 orientated vertically in these drawings, namely a drive wheel 201, a lunar month moving part 202 and a detent part 203 on which is fixed a hand B permanently indicating the position of the repeated month. It is noted that it is proposed in the case of a year without a repeat month, the hand B is positioned at midday on the scale 204. These three rotating parts are mounted between a support plate and the dial of the timepiece, which are not shown. The upper face of the dial is provided with a circular month scale 204 divided into equal fields numbered from 1 to 12 starting from the Chinese New Year. An indicator formed by a hand 206 fixed on a plate 207 of the month moving part 202 points to this scale. This moving part further comprises a toothed satellite wheel 208 mounted to rotate on the lower face of the plate 207, spaced from the centre of the plate. The satellite wheel 208 is permanently braked on the plate 207 by a frictional retaining device, for example an elastic washer inserted between these two parts. On the opposite side of the plate, the satellite wheel has a series of detent elements 209, six in number in the present case, which are distributed round its circumference to cooperate with a finger 210 of the detent part 203. The detent elements 209 can be in the form of radial blades or teeth. In the position shown in FIGS. 10 and 11, in which the hand 206 points to the twelfth field of the scale 204 and thus indicates the last month of the year, two successive detent elements 209 follow the edge of an arc of a circle of a fixed blocking plate 212 which ensures a precise orientation of the satellite wheel 208 and prevents it turning at this place.

The drive wheel 201 comprises a first set of teeth 213 with twelve teeth on the outside and a second set of teeth 214 on the inside which mesh with the satellite wheel 208. The teeth 213 enable an element of the calendar mechanism of the timepiece, for example the rocking lever 114 in the embodiment according to FIG. 4, to turn the wheel 201 by a twelfth of a revolution at each new moon.

The angular position of the detent finger 210 relative to the month scale 204 corresponds to the position of a possible leap month in the sequence of lunar months of the current year. This position is defined by a rotary year cam 215 of annular form whose interior edge has a step 216 for each year of the lunar-solar calendar whose level (in this case the distance from the centre of the cam) represents either the absence of a leap month or the rank of a leap month among the other months of the year. Since a leap month is never the last of the year in the Chinese calendar, the cam 215 has eleven levels for the leap months and a twelfth to represent the ordinary years. In the present example the cam 215 is provided for a series of 76 years (4×19) of the Chinese calendar but this number is arbitrary and can be different, for example 60. After this series of years the cam 215 is replaced by a cam representing the following series of years.

During each year, a feeler 218 pivoted at 219 is held by a spring against the corresponding step 216 of the cam 215. The feeler 218 comprises a rack 220 as a means of transmission, which meshes with a toothed element 221 of the detent part 203 so as to position the finger 210 as a function of the level of the step. When the level corresponds to an ordinary year, the finger 210 is positioned facing the blocking plate 212, a position in which the detent part 203 is displaced axially towards the bottom by a fixed ramp so that the detent elements 209 of the satellite wheel 208 can pass above the finger 210 without interfering with it.

At each Chinese New Year, the year cam 215 has to turn about its centre to advance by one step when the display device passes the last month of a year to the first month of the following year. This movement can be produced by a tooth 224 fixed on the plate 207 and acting on an engaging mechanism (not shown) which is in mesh with a set of teeth of the cam 215. This mechanism should also return the feeler 218 to space it from the cam 215 just before this turns, then reset the feeler after the movement of the cam, which puts the detent finger 210 in the position which is appropriate for the year to come. The rotation of the plate 207 at the New Year arranges the hand 206 on the number 1 of the month scale.

If the year is not a leap year, the feeler 218 takes its position the furthest to the left, against a step of the twelfth level of the cam 215, so that the finger 210 is located facing the plate 212, as explained above, and thus does not have an effect during this year. At each new moon the rotation of the drive wheel 210 by a twelfth of a revolution in the clockwise sense moves the satellite wheel 208 and produces an equal rotation of the plate 207 and of the hand 206, since the braked satellite wheel cannot turn on its own. At the end of the twelfth lunar month the plate 207 will have made a complete revolution and the operations described in the preceding paragraph are repeated.

If the year is a leap year, the feeler 218 is arrested less far away by the cam 215 and keeps the finger 210 during the whole year in a position which corresponds to the number of the month which precedes the leap month, for example as is shown in FIGS. 12 to 14. More particularly, this position is such that, when the hand 206 indicates the number of the month preceding the leap month (the position according to FIG. 12), the finger 210 forms a stop in front of the nearest one of the detent elements 209 of the satellite wheel 210. At the end of this month, when the drive wheel 201 performs a twelfth of a revolution in the sense indicated by the arrow A and thus pushes the satellite wheel 208, the finger 210 retains the detent element 209 and thus forces the satellite wheel 218 to turn by itself by overcoming the braking couple to which it is subjected. The rotation of the plate 207 is then strongly reduced so that the hand 206 stays in the field carrying the number of the preceding month on the scale 204. FIG. 13 shows this position of the display device. A sign 225 of the leap month (FIG. 11) is advantageously provided in the fields 1 to 11 of the month scale in the zone where the hand 206 is located in this situation. At the end of this month, the new step of the drive wheel 201 effects a rotation of a fraction of a revolution (a sixth of a revolution in the illustrated example) corresponding to the number of detent elements of the satellite wheel 208, as well as the reduced rotation of the plate 207, so that the hand 206 passes to the following field of the scale 204 to increment by one the number of the month in attaining the position of FIG. 14. The finger 210 will not have an effect any longer during the remainder of the year. Thus in the course of the thirteen lunar months of a leap year, the drive wheel 201 advances by 13/12 of a revolution while the month moving part 202 and its hand 206 make exactly one complete revolution.

Obviously the example described here is only one possible embodiment for displaying the month and it can the subject of many modifications and variants within the scope of a man skilled in the art. For example, instead of the detent finger 210 being displaced axially into its position corresponding to an ordinary year, it could be mounted elastically on the detent part 203, so that the satellite wheel 208, prevented from turning by the blocking plate 212, pushes it back and passes over it at the beginning of the first month of the year. The elastic retention of the finger should nevertheless be strong enough to overcome the friction of the satellite wheel 208 at the start of a leap month.

It is possible to configure the year cam 215 in different ways in order to adapt to the rules regarding the leap years and months in different lunar-solar calendars, which allows the principles of the present invention to be applied to displays of the Greek, Jewish or Indian calendar for example.

Figure 6:
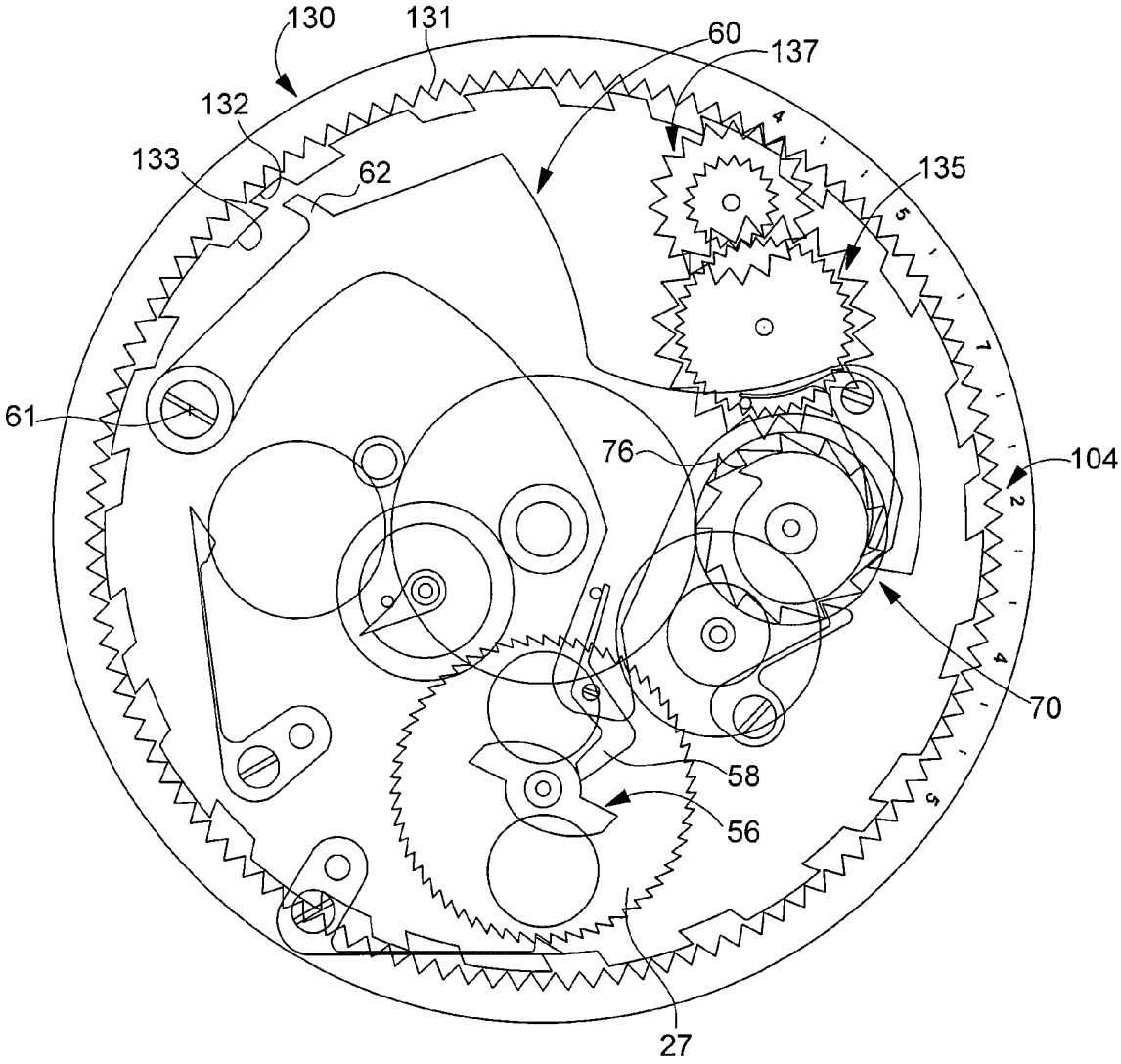
FIG. 6 is a view like FIG. 2 and shows a fourth embodiment of the invention.

FIG. 6 shows an embodiment similar to that of FIG. 2 and functioning in the same manner, with the differences described below. The Chang cam 63 of FIG. 2 is replaced by an annular Chang cam denoted here as 130, the inside of which carries toothing 131 and low sectors 132 and high sectors 133 of the same angular extent, representing the ordinary and leap years respectively of the Chinese calendar. In this example, the cam has three times nineteen of these sectors and performs a complete revolution in fifty seven years, namely three Chang cycles. The finger 62 of the rocking lever 60 pivoted at 61 abuts the sector corresponding to the current year when the rocking lever is raised sufficiently by the cam 56 of the moon indicator, as in the first embodiment. In order to drive the cam 130 once per year, in place of the wheels 66 and 67 of FIG. 2 there is provided a train with two double wheel moving parts 135 and 137, of which the first is actuated at each Chinese New Year by the finger 76 of the month moving part 70, while the second is in permanent engagement with the toothing 131 of the ring of the cam 130. This ring can also carry indications characteristic of the Chinese year, in particular the indication 104 of the number of the leap month for display in the window 103, as in the example of FIGS. 3 and 4.

Figure 7:
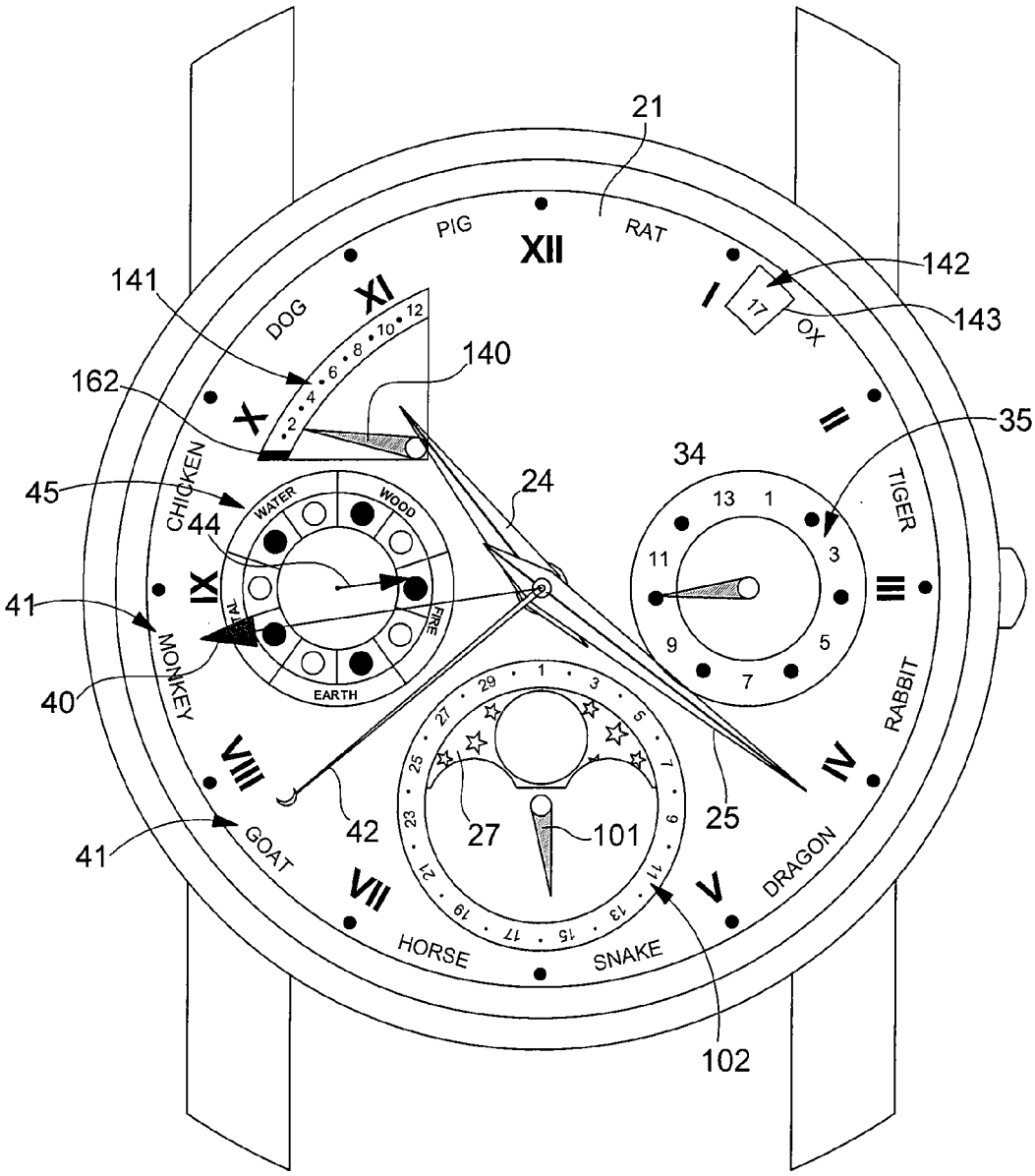
FIGS. 7 and 8 are views like FIGS. 1 and 2 and show a fifth embodiment of the invention.
Figure 8:
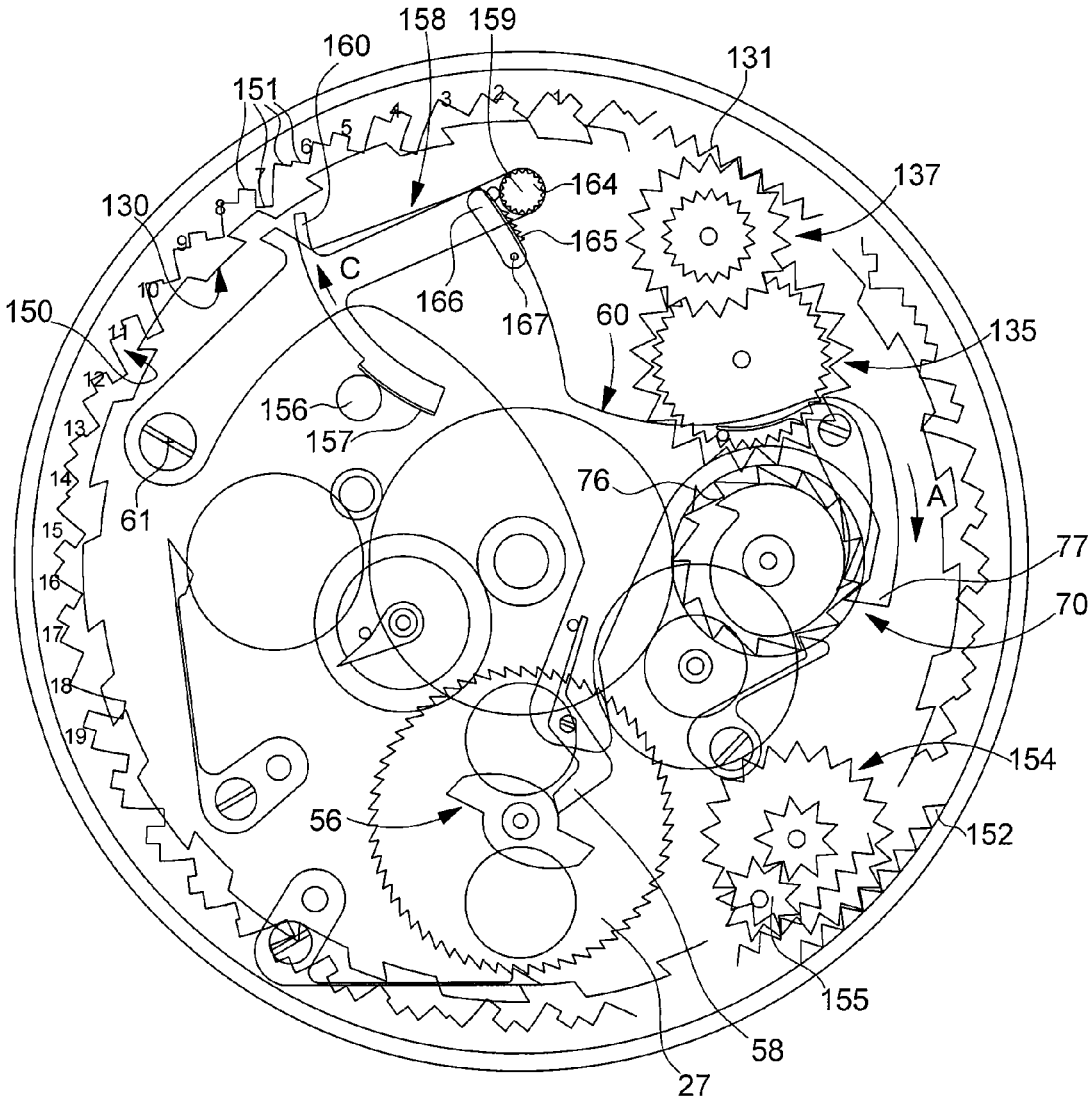

FIGS. 7 and 8 show a variant of the embodiment illustrated by FIG. 6. This variant comprises the indication of the leap month, which is effected here by means of a hand 140 of the retrograde type relative to a scale 141 forming a sector of a circle graduated from 1 to 12, and the indication of the number 142 of the current year in the Chang cycle, appearing in the window 143.

The appropriate mechanism uses all the elements of that of FIG. 6, save that the indication 104 is replaced by that 142 of the number of the year, through symbols on the ring of the Chang cam 130. Below this cam there is a second ring cam 150 whose inside edge comprises a number M of shoulders 151 whose height represents the number of the leap month in a Chinese leap year (being eleven possible heights, since the leap month if never the last month of the Chinese year), with in addition a twelfth height of zero corresponding to ordinary years. This cam 150 of leap months has internal toothing 152 enabling it to be driven by the teeth 131 of the cam 130 via double wheel gear transmission 154 and a reversing wheel 155. These two cams thus advance simultaneously once per year but not by the same angle.

The retrograde hand 140 is fixed to a wheel 156 engaging the serrations 157 of a rack 158 pivoted at 159 and biased by a spring in the sense of the arrow C. A finger 160 of the rack thus comes into abutment with that shoulder 151 of the cam 150 which corresponds to the current Chinese year. If the height of the step is zero, this signifies that the year is ordinary and the hand of the watch is located facing a particular mark 162 at the bottom of the scale 141. If the Chinese year is leap, the shoulder has a non zero height which determines the appropriate positions of the rack and of the hand 140 to indicate the number of the leap month. The wearer of the watch uses this indication in combination with the indication of the lunar month by the hand 34.

At the instant of the Chinese New Year the drop of the rocking lever 60 will effect instantaneous movements of the month moving part 70, the gear trains 135 and 137 driven by the finger 76, as well as the two ring cams 130 and 150. It is necessary at this instant to reset the rack 158 briefly to disengage the finger 160 from the cam 150. To this end the base of the rack is provided with a wheel 164 (which may be reduced to a toothed sector) which is engaged by rack teeth 165 of a lever 166 pivoted at 167 on the rocking lever 60. The device resets the rack at the start of the movement of the rocking lever in the sense of the arrow A and retains the rack up to the stage at which the finger 76 of the moving part 70 has completed its action. The rack teeth 165 are then disengaged from the wheel 164, so that the rack is brought back against the new shoulder 151 of the cam 150 by its spring.

Figure 9:
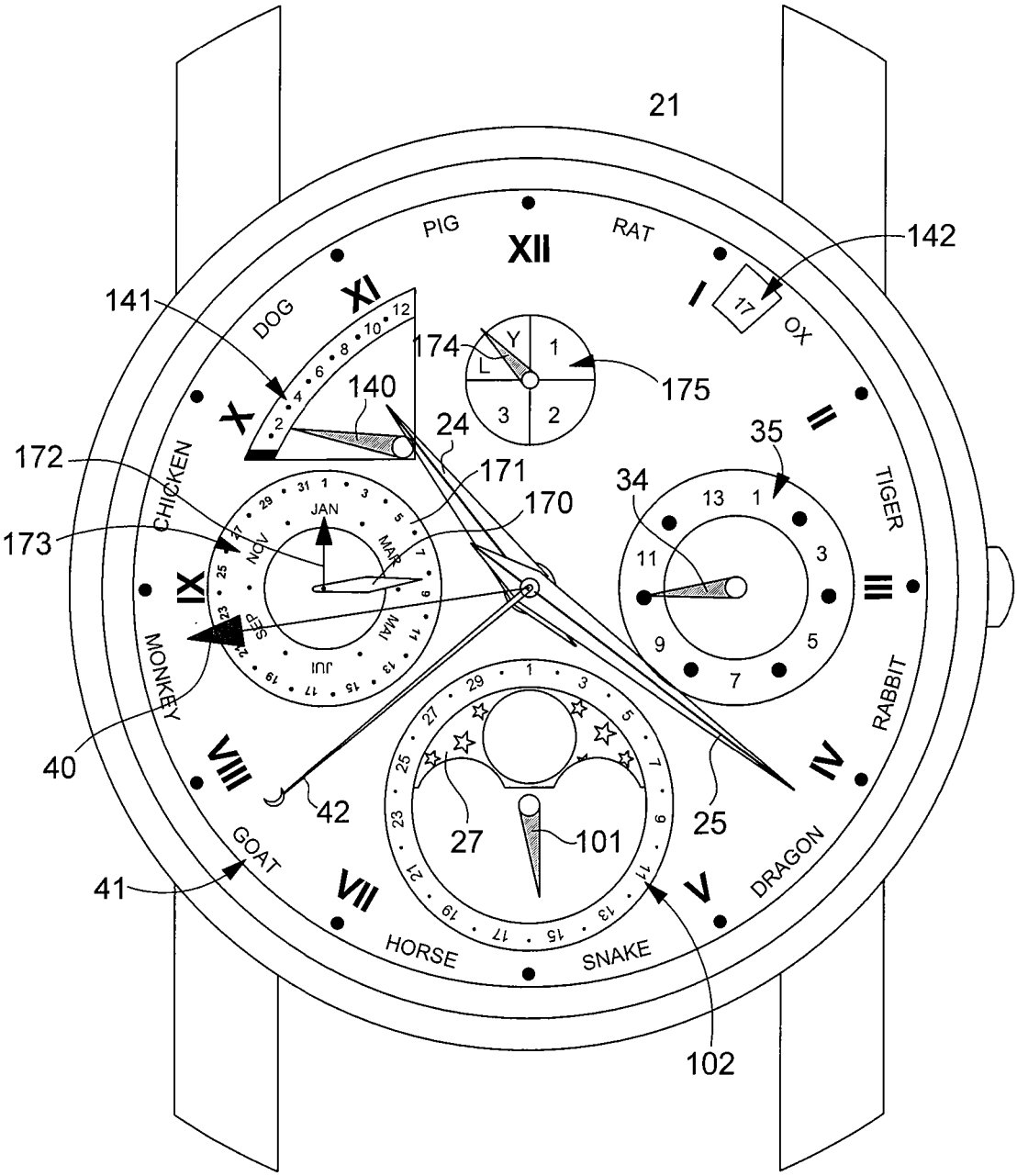
FIG. 9 is a view like FIG. 1 and shows a sixth embodiment of the invention.

FIG. 9 shows an embodiment in which a Chinese calendar display according to the present invention, in particular in the version of FIG. 7, is combined in the same watch with a display of the Julian calendar by means of a conventional perpetual calendar mechanism. This mechanism can be of well known type driven from an hour wheel, and is not shown here. The display of the Chinese cycle of ten years by the hand 44 and the scale 45 (FIG. 7) is replaced by two concentric indicators, namely a hand 170 indicating the Julian day of the month against a scale 171 and a hand 172 indicating the Julian month against a scale 173. Furthermore a hand 174 performs one revolution in four year to indicate the year within the Julian cycle of four year against a scale 175 comprising a symbol LY which identifies a Julian leap year.

What is claimed is:

1. A timepiece comprising:

(a) a timepiece movement;

(b) a dial;

(c) time indicator members;

(d) a lunar moving part driven by the timepiece movement and performing one revolution during an integral number of synodic months;

(e) calendar indicator members that are movable relative to the dial; and (f) a calendar mechanism driven by the timepiece movement and comprising a moving part for months that completes one revolution per ordinary year and per leap year, wherein the calendar is a lunar-solar calendar comprising ordinary years comprising twelve lunar months and leap years comprising thirteen lunar months, and wherein the moving part for months is driven by the lunar moving part.

2. The timepiece according to claim 1, wherein the month moving part is associated with a month indicator.

3. The timepiece according to claim 1, wherein the lunar moving part is associated with and indicator of the age of the moon.

4. The timepiece according to claim l, wherein the calendar mechanism comprises a rocking lever arranged to bear against a Chang cam comprising nineteen, or a multiple of nineteen, angular sectors with respective small and large heights to represent years of twelve or thirteen lunar months, the Chang cam being driven by the month moving part so as to turn through an angle corresponding to one sector at the end of each revolution of said moving part, wherein the rocking lever is actuated once per lunar month by a cam connected to the lunar moving part and has a first nose arranged to advance the month moving part by a thirteenth of a revolution on each actuation of the rocking lever and wherein the rocking lever is provided with a second nose arranged to engage in a recess of the month moving part to advance this moving part by a supplementary thirteenth of a revolution in the course of each year in which the rocking lever bears against a sector of small height of the Chang cam.

5. The timepiece according to claim 4, wherein said recess is located on a second cam in the form of a spiral forming part of the month moving part, the second nose being formed by a pawl mounted on the rocking lever and biased by a spring so as to be applied elastically against said second cam.

6. The timepiece according to claim 4, wherein the month moving part comprises a wheel with thirteen teeth on which the first nose of the rocking lever acts, a finger arranged to advance the Chang cam by one step per year, and a pinion adapted to drive at least one year indicator.

7. The timepiece according to claim 1, wherein the calendar indicator members comprise a first year indicator driven from the month moving part and performing one revolution in twelve years.

8. The timepiece according to claim 1, wherein the calendar indicator members comprise a year indicator driven from the moving part for months and completing one revolution in ten years.

9. The timepiece according to claim 7, wherein said year indicator completing one revolution in ten years is driven from a wheel of the first year indicator.

10. The timepiece according to claim 4, wherein the calendar indicator members comprise a third year indicator coupled to the Chang cam and that indicates the position of the current year against a scale of nineteen years in which the leap years are distinguished from the ordinary years, or in a window of the dial.

11. The timepiece according to claim 1, wherein the calendar indicator members comprise an indication of the number of the leap lunar month in the leap years, this number being placed on a year rotary element moved by one step each year and appearing in a window of the dial.

12. The timepiece according to claim 4, wherein the calendar indicator members comprise an indicator of the number of the leap lunar month in the leap years by means of a retrograde hand controlled by a rack that senses a cam moved by one step each year.

13. The timepiece according to claim 3, wherein the indicator of the age of the moon is driven step by step by the timepiece movement in such a manner as to perform one revolution in thirty days and is provided with a manual correction device enabling a user to effect a supplementary step of said indicator.

14. The timepiece according to claim 13, wherein the calendar mechanism comprises a rocking lever actuated once per lunar month by a second cam coupled to the lunar moving part and comprising a nose arranged to advance the month moving part by a twelfth of a revolution on each actuation of the rocking lever.

15. The timepiece according to claim 11, wherein the month moving part comprises a wheel with twelve teeth on which the nose of the rocking lever acts, a manual correction device and a finger arranged to advance said year rotary element by one step each year.

16. The timepiece according to claim 2, wherein the month indicator comprises concentrically a moving part of lunar months driven step by step to perform one revolution per ordinary year and per leap year and provided with a month indicator which associated with a scale of twelve months, the moving part of lunar months having a plate carrying a toothed satellite wheel whose rotation on the plate is impeded by a restraining device, the satellite wheel further having detent elements distributed uniformly round a circumference of the satellite wheel, a drive wheel having a first set of teeth for entrainment through a twelfth of a revolution at the end of each month, and a second set of teeth which mesh with those of the satellite wheel, and a rotary detent finger adapted to form an abutment for at least one of the detent elements of the satellite wheel and thus to turn the satellite wheel while overcoming the force of the restraining device when the plate turns; the device further comprising positioning means arranged to position and hold the detent finger in a selected position corresponding to a month of said scale.

17. The timepiece according to claim 16, wherein the positioning means comprise a year cam having a step for each year of a series of years, the level of the step representing the absence or presence of a leap month in the year and the rank of the possible leap month, a feeler adapted to be applied to the step corresponding the current year on the year cam, and a transmission mechanism between the feeler and the detent finger.

18. The timepiece according to claim 16, further comprising a hand integral with the detent part and associated with said scale of twelve months to indicate permanently the leap month of the year.

19. The timepiece according to claim 2, wherein the calendar mechanism comprises a rocking lever arranged to bear against a Chang cam comprising nineteen, or a multiple of nineteen, angular sectors with respective small and large heights to represent years of twelve or thirteen lunar months, the Chang cam being driven by the month moving part so as to turn through an angle corresponding to one sector at the end of each revolution of said moving part, wherein the rocking lever is actuated once per lunar month by a cam connected to the lunar moving part and has a first nose arranged to advance the month moving part by a thirteenth of a revolution on each actuation of the rocking lever and wherein the rocking lever is provided with a second nose arranged to engage in a recess of the month moving part to advance this moving part by a supplementary thirteenth of a revolution in the course of each year in which the rocking lever bears against a sector of small height of the Chang cam.

20. The timepiece according to claim 3, wherein the calendar mechanism comprises a rocking lever arranged to bear against a Chang cam comprising nineteen, or a multiple of nineteen, angular sectors with respective small and large heights to represent years of twelve or thirteen lunar months, the Chang cam being driven by the month moving part so as to turn through an angle corresponding to one sector at the end of each revolution of said moving part, wherein the rocking lever is actuated once per lunar month by a cam connected to the lunar moving part and has a first nose arranged to advance the month moving part by a thirteenth of a revolution on each actuation of the rocking lever and wherein the rocking lever is provided with a second nose arranged to engage in a recess of the month moving part to advance this moving part by a supplementary thirteenth of a revolution in the course of each year in which the rocking lever bears against a sector of small height of the Chang cam.

* * * * *